US007318381B2

(12) United States Patent
Arnold et al.

(10) Patent No.: US 7,318,381 B2
(45) Date of Patent: Jan. 15, 2008

(54) METHODS AND SYSTEMS FOR DETERMINING AND CONTROLLING THE PERCENT STOICHIOMETRIC OXIDANT IN AN INCINERATOR

(75) Inventors: Kenny M. Arnold, Broken Arrow, OK (US); Jianhui Hong, Broken Arrow, OK (US); Joseph D. Smith, Owasso, OK (US)

(73) Assignee: John Zink Company, LLC, Tulsa, OK (US)

( * ) Notice: Subject to any disclaimer, the term of this patent is extended or adjusted under 35 U.S.C. 154(b) by 396 days.

(21) Appl. No.: 10/963,051

(22) Filed: Oct. 12, 2004

(65) Prior Publication Data

US 2006/0275718 A1 Dec. 7, 2006

Related U.S. Application Data

(63) Continuation-in-part of application No. 10/339,362, filed on Jan. 9, 2003, now abandoned.

(51) Int. Cl.
*F23N 5/00* (2006.01)
*F23N 5/10* (2006.01)

(52) U.S. Cl. ..... 110/185; 110/188; 110/190; 236/15 E; 431/76

(58) Field of Classification Search ..... 431/12, 431/75, 76; 236/15 E; 110/185, 186, 188, 110/190, 235, 345, 346
See application file for complete search history.

(56) References Cited

U.S. PATENT DOCUMENTS

| | | | |
|---|---|---|---|
| 4,151,503 | A | 4/1979 | Cermak et al. |
| 4,279,208 | A | 7/1981 | Guillaume et al. |
| 4,283,256 | A | 8/1981 | Howard et al. |
| 4,391,691 | A | 7/1983 | Linder et al. |
| 4,459,923 | A | 7/1984 | Lewis |
| 4,474,121 | A | 10/1984 | Lewis |
| 4,517,906 | A | 5/1985 | Lewis et al. |
| 5,123,364 | A | 6/1992 | Gitman et al. |
| 5,222,887 | A | 6/1993 | Zabielski, Sr. |
| 5,653,106 | A | 8/1997 | Katashiba et al. |

FOREIGN PATENT DOCUMENTS

| | | |
|---|---|---|
| EP | 0 561 044 A1 | 9/1993 |
| EP | 1 437 548 A1 | 7/2004 |

*Primary Examiner*—Jiping Lu
(74) *Attorney, Agent, or Firm*—McAfee & Taft

(57) ABSTRACT

Methods and systems for measuring and controlling the percent stoichiometric oxidant in the pyrolyzing section of incinerators are provided. The methods and systems rely on measurements of the oxygen concentration and temperature of the gases within the pyrolysis section and mathematical relationships between these values and the percent stoichiometric oxidant.

18 Claims, 2 Drawing Sheets

METHODS AND SYSTEMS FOR DETERMINING AND CONTROLLING THE PERCENT STOICHIOMETRIC OXIDANT IN AN INCINERATOR

This application is a continuation-in-part of application Ser. No. 10/339,362 filed on Jan. 9, 2003 now abandoned.

BACKGROUND OF THE INVENTION

1. Field of the Invention

This invention relates generally to combustion processes and more particularly to methods and devices for determining the percent stoichiometric oxidant in the pyrolysis section of incinerators.

2. Description of the Prior Art

In incineration applications, it is common practice to employ two stages of combustion. In the first stage, combustion air is supplied at a rate less than the stoichiometric air requirement. The stoichiometric air requirement is defined as the air flow rate required for complete combustion of the fuel and waste streams. Complete combustion means that the products of combustion are stable compounds such as $CO_2$, $H_2O$, $N_2$ and He (if existing).

Thus, in the first stage the wastes are commonly pyrolyzed in an oxygen-deficient atmosphere. This furnace, or portion of the furnace, is commonly referred to as a reduction, primary combustion, oxygen-deficient, or pyrolyzing furnace or chamber. Additional combustion air is then supplied at a subsequent section to destroy any products of incomplete combustion. This secondary section is typically referred to as a re-oxidation section or afterburner.

Pollutant emissions are strongly influenced by the amounts of combustion air supplied to the pyrolyzing section and the afterburner. Therefore, it is highly desirable to be able to measure and control the air supply to both sections. The air supply to the afterburner is typically regulated to achieve a certain level of excess oxygen in the stack exhaust gases, or in some cases to achieve a target temperature. The air, or oxidant, supply to the pyrolyzing section is more difficult to control. It is desirable to measure and control the oxidant supply to the pyrolyzing section as a percent stoichiometric oxidant, or "PSO." The PSO is equal to the actual oxidant supply divided by the stoichiometric oxidant supply expressed as a percent. Although oxidants include compounds such as NO and $NO_2$, in practice the main source of oxidant for incinerators is generally air. Therefore the term "PSA" (percent stoichiometric air) is often used in place of PSO.

The PSO can also be related to an equivalence ratio. The equivalence ratio is defined as the actual fuel-to-air ratio divided by the stoichiometric fuel-to-air ratio. The equivalence ratio is related to PSO in that the equivalence ratio is simply 100/PSO. Where fuel and air are supplied to achieve complete combustion, the reaction is said to be stoichiometric, the PSO is equal to 100% and the equivalence ratio is equal to 1.

One common means of directly regulating the air supply to the pyrolyzing furnace is to measure the flow rates of fuel, waste, and air; calculate the PSO; and then control the PSO to a certain value by changing the air supply. Waste compositions often vary with time, or are simply unknown. In practice, because of the difficulties associated with the uncertainties and fluctuations in waste compositions, the waste is often excluded from the stoichiometric air requirement calculation. Because of this exclusion, the method cannot accurately reflect the correct air requirement.

Other common methods for controlling the air supply are either measuring and controlling the combustible level in the pyrolyzing furnace or measuring the temperature change due to addition of afterburner air. These methods are indirect ways of controlling the PSO and do not determine the actual PSO or consider the effect of varying temperature on the actual PSO.

Some methods include use of oxygen sensors in the exhaust gas. For example, U.S. Pat. No. 4,459,923 filed in 1983, by F. M. Lewis, describes a method for controlling the operation of a multiple hearth furnace by controlling the temperature of the hottest hearth and maintaining a minimum $O_2$ content of the exhaust gas. The PSA is calculated from the oxygen measurement in the exhaust gases using the equation:

$$PSA=[1+\%\ O_2/(21-\%\ O_2)]\times 100$$

Of course, this relationship is only useful if the PSA is greater than 100% since the oxygen concentration cannot be negative or greater than 21% in the exhaust gases when ambient air (rather than pure oxygen) is used; this expression cannot, and is not intended to, produce a result less than 100%. Thus the relationship requires a fuel-lean or super-stoichiometric combustion and is not applicable to fuel-rich or sub-stoichiometric combustion wherein the oxygen level becomes very low (such as ppm or even ppb level). Indeed, application of this equation in a fuel-rich combustion will result in an erroneous conclusion that the PSA is equal to 100% when it should actually be much less than 100%. Additionally, while maintenance of a constant temperature within certain $O_2$ measurement boundaries provides a means of control, these prior art control methods are not based on the actual PSA. Generally, the control approach has been to maintain a constant temperature rather that a constant PSA, and there has been no attempt to calculate the actual PSA variations due to changes in temperature.

Oxygen sensors have also been used to measure the air/fuel ratio, or equivalence ratio, in internal combustion engines and such devices have been widely used in automobiles (see, for example, U.S. Pat. No. 4,283,256 filed in 1980, by Howard and Wheetman). However, these sensors do not take into account the dependency of equivalence ratio on oxygen level and temperature and therefore cannot operate in wide ranges of temperatures. Fortunately, such devices are able to neglect the effect of temperature on predictions of the equivalence ratio because the exhaust gas temperatures are normally regulated within a relatively narrow range.

Still other devices have been developed due to the recognized need to account for the effects of temperature. For example, U.S. Pat. Nos. 4,151,503 and 4,391,691 utilize semiconductor chips processed to exhibit a rapid change in electrical resistance responsive to differences in exhaust gas temperature. The temperature-dependent electrical resistance is used to compensate the signal from the oxygen sensor to produce a more accurate prediction of the PSO. Due to the mechanical and electrical characteristics of the materials used in the temperature-compensating chips, such devices cannot be operated in the high temperatures (1400° to 3200° F.) commonly seen in the pyrolyzing sections of incinerators.

Thus, there are needs for methods to directly measure the PSO in pyrolosis sections of incinerators that compensate for temperature fluctuations and that avoid the problems described above.

SUMMARY OF THE INVENTION

By the present invention, methods of measuring, determining and controlling the percent stoichiometric oxidant, "PSO," in the pyrolyzing section of an incinerator, and systems for use in measuring, determining and controlling the PSO are provided which meet the above-described needs and overcome the deficiencies of the prior art. The methods for measuring and determining the PSO in the pyrolyzing section of an incinerator are basically comprised of the following steps. An electrical signal corresponding to oxygen concentration is generated utilizing an oxygen sensor positioned to sense oxygen concentration or partial pressure in the gases within the pyrolyzing section. An electrical signal corresponding to temperature is generated using a temperature sensor positioned to sense the temperature of the gases within the pyrolyzing section. The electrical signals are then conducted to a processor for converting the electrical signals from the oxygen sensor and the temperature sensor to an estimate of the PSO using a mathematical relationship between the electrical signals and the PSO. The mathematical relationship includes adjustment of the PSO estimate due to temperature and temperature variations wherein the temperature is above 1100° F.

Methods of this invention for controlling the PSO in the pyrolyzing section of an incinerator comprise generating the electrical signals corresponding to oxygen concentration and temperature as described above and conducting the signals to a processor for converting the signals to an estimate of the PSO using the mathematical relationship described above. The PSO estimate is relayed to a feedback controller for generating a combustion air blower, oxidant or fuel flow control signal to adjust the combustion air, oxidant or fuel flow based on the PSO estimate and a pre-selected PSO value. The control signal is then relayed to the combustion air blower, oxidant or fuel control device.

The systems for use in measuring and determining the PSO in the pyrolyzing section of an incinerator basically comprise the following: a means for generating an electrical signal corresponding to oxygen concentration in the gases within the pyrolyzing section, a means for generating an electrical signal corresponding to the temperature of the gases within the pyrolyzing section, and a device for converting the electrical signals corresponding to oxygen concentration and temperature to an estimate of the PSO using a mathematical relationship between the electrical signals and the PSO. The mathematical relationship includes adjustment of the PSO estimate due to temperature and temperature variations wherein the temperature is above 1100° F.

The systems for use in controlling the PSO in the pyrolyzing section of an incinerator basically comprise the means and device described above for measuring and determining the PSO at varying temperatures wherein the temperatures are above 1100° F., a controller for controlling the amount of combustion air, oxidant or fuel to the pyrolyzing section of the incinerator, and a means for generating a control signal for the combustion air control device based on the PSO estimate and a pre-selected PSO value.

DESCRIPTION OF PREFERRED EMBODIMENTS

Figure 1:
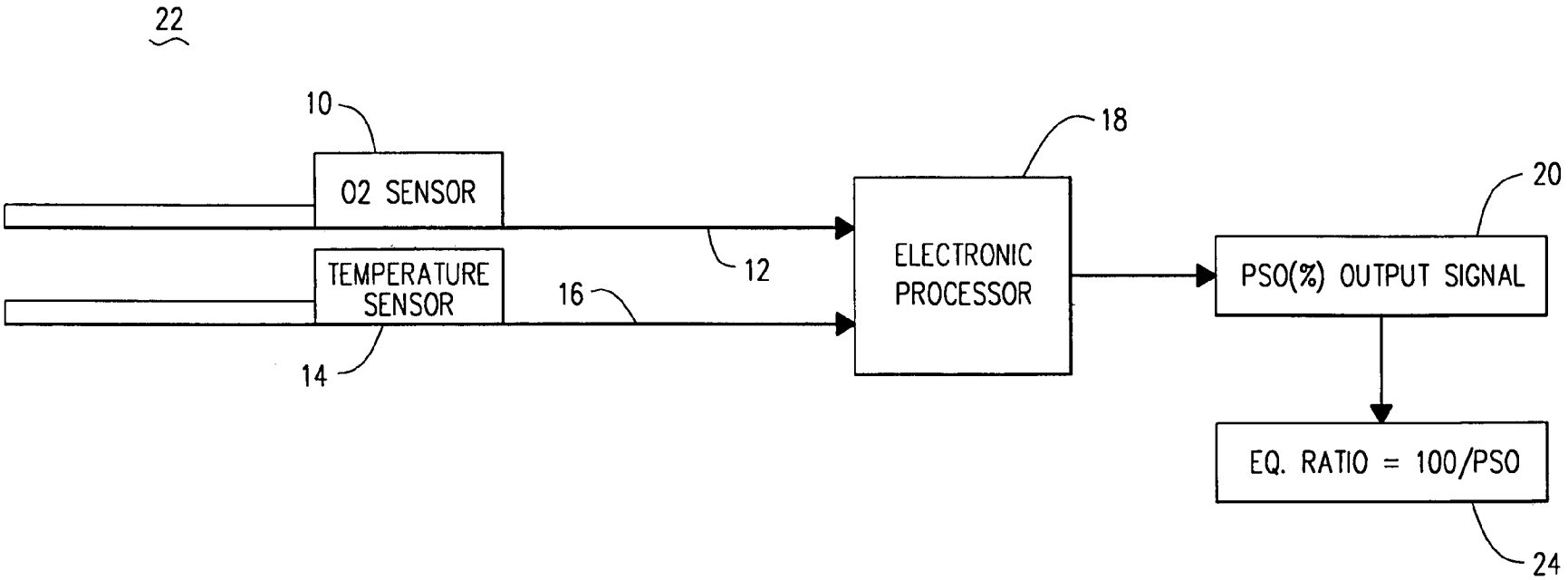
FIG. 1 shows a typical incinerator with the inventive system for measuring the PSO in the pyrolyzing section operation.

Preferred methods of this invention for measuring and determining the PSO in the pyrolyzing section of an incinerator basically comprise the following steps. An electrical signal corresponding to oxygen concentration is generated utilizing an oxygen sensor positioned to sense oxygen concentration or partial pressure in the gases within the pyrolyzing section. An electrical signal corresponding to temperature is generated using a temperature sensor positioned to sense the temperature of the gases within the pyrolyzing section. The electrical signals are then conducted to a processor for converting the electrical signals from the oxygen sensor and the temperature sensor to an estimate of the PSO using a mathematical relationship between the electrical signals and the PSO. The mathematical relationship includes adjustment of the PSO estimate due to temperature and temperature variations wherein the temperature is above 1100° F. The general method is shown in FIG. 1.

Suitable oxygen sensors 10 that can be used in this invention for generating an electrical signal 12 corresponding to oxygen concentration include, but are not limited to, zirconia-based oxygen sensors, electrochemical sensors, micro-fuel sensors, and paramagnetic sensors. Of these, zirconia-based sensors are preferred. A particularly suitable oxygen sensor 10 is commercially available under the trade designation "Oxyfire™" from Marathon Sensors, Inc., of Cincinnati, Ohio. The sensor 10 should be positioned to sense the oxygen concentration or partial pressure in the gases just within the pyrolyzing section of the incinerator.

Suitable temperature sensors 14 that can be used in this invention for generating an electrical signal corresponding to temperature include, but are not limited to, thermocouples, resistance temperature detectors, pyrometers and remote temperature devices. Of these, thermocouples are preferred. Particularly suitable thermocouples are commercially available as Type B or Type R integral thermocouple probes available from Marathon Sensors, Inc., of Cincinnati, Ohio. The sensor 14 should be positioned to sense the temperature of the gases just within the pyrolyzing section of the incinerator and as close as possible to the oxygen sensor.

Signals 12 and 16 from the oxygen and temperature sensors are conducted to a processor 18 to calculate an estimate of the PSO 20. A particularly suitable processor 18 is commercially available as a "VersaPro™" Stoichiometric Monitor from Marathon Sensors Inc., of Cincinnati, Ohio.

The processor 18 is programmed according to this invention to calculate an estimate of the PSO 20 using a mathematical relationship developed from equilibrium calculations. This method is based on the initial assumption that the pyrolyzing section 22 has a residence time long enough to allow the oxygen concentration to reach close to its equilibrium value. Adjustments for actual non-equilibrium operating conditions can generally be made once the unit is in operation.

PSO can be expressed as a function of oxygen concentration and temperature in a plurality of different forms. Among these forms, two are found to be most suitable. The first form is a sigmoid function:

$$PSO=a+b/[1+((x+eT)c)^d]$$

where x is the oxygen sensor output in millivolts, T is the temperature in ° F., and a through e are empirical constants.

Using a zirconia-based oxygen sensor, a suitable set of empirical constants providing the PSO in percent is the following:

$$a=-733.109;\ b=873.246;\ c=1610.403;\ d=15.176;\ e=0.2439$$

The second preferred expression is in the form of a polynomial:

$$PSO=[a+b(x+eT)+c(x+eT)^2+d(x+eT)^3]\times 100$$

where, again, x is the oxygen sensor output in millivolts, T is equal to ($T_f$−2100) and $T_f$ is the temperature in ° F., and a through e are empirical constants. Using a zirconia-based oxygen sensor, a suitable set of empirical constants providing the PSO in percent is the following:

$$a=3.424;\ b=-1.3433E\text{-}02;\ c=2.4979E\text{-}05;\ d=-1.5670E\text{-}08;\ e=0.2439$$

Although the sigmoid and polynomial correlations are derived from equilibrium calculations of methane/air mixtures, they have been applied for general hydrocarbon/air combustion and have shown very good agreement. These correlations have also been used in incineration applications (hydrocarbon, air, and waste stream) and shown good agreement between actual PSO and predicted PSO. These correlations do not work well for H2/air combustion, CO/air combustion, or hydrocarbon/pure $O_2$ combustion.

The equivalence ratio 24 can also be expressed in terms of the oxygen and temperature signals since the equivalence ratio is simply 100/PSO. For example, if the PSO 20 is 80%, the equivalence ratio 24 is 100/80 or 1.25.

The methods of this invention for measuring and determining PSO can be applied to combustion of many types of waste compounds such as $NH_3$, HCN, $C_2H_3N$, $C_3H_3N$, saturated and unsaturated organic fuels such as paraffins, olefins, cycloparaffins, acetylenes and aromatic compounds with very little error. The accuracy may be affected by excessive amounts of compounds containing bound oxygen such as water ($H_2O$), $NO_2$ and NO. Here "excessive amount" is defined as more than about one pound of bound oxygen from any stream directed into the incinerator (e.g., waste stream or quench stream) for each pound of hydrocarbon fuel where the hydrocarbon fuel can be either waste or the fuel supplied for normal operation.

Figure 2:
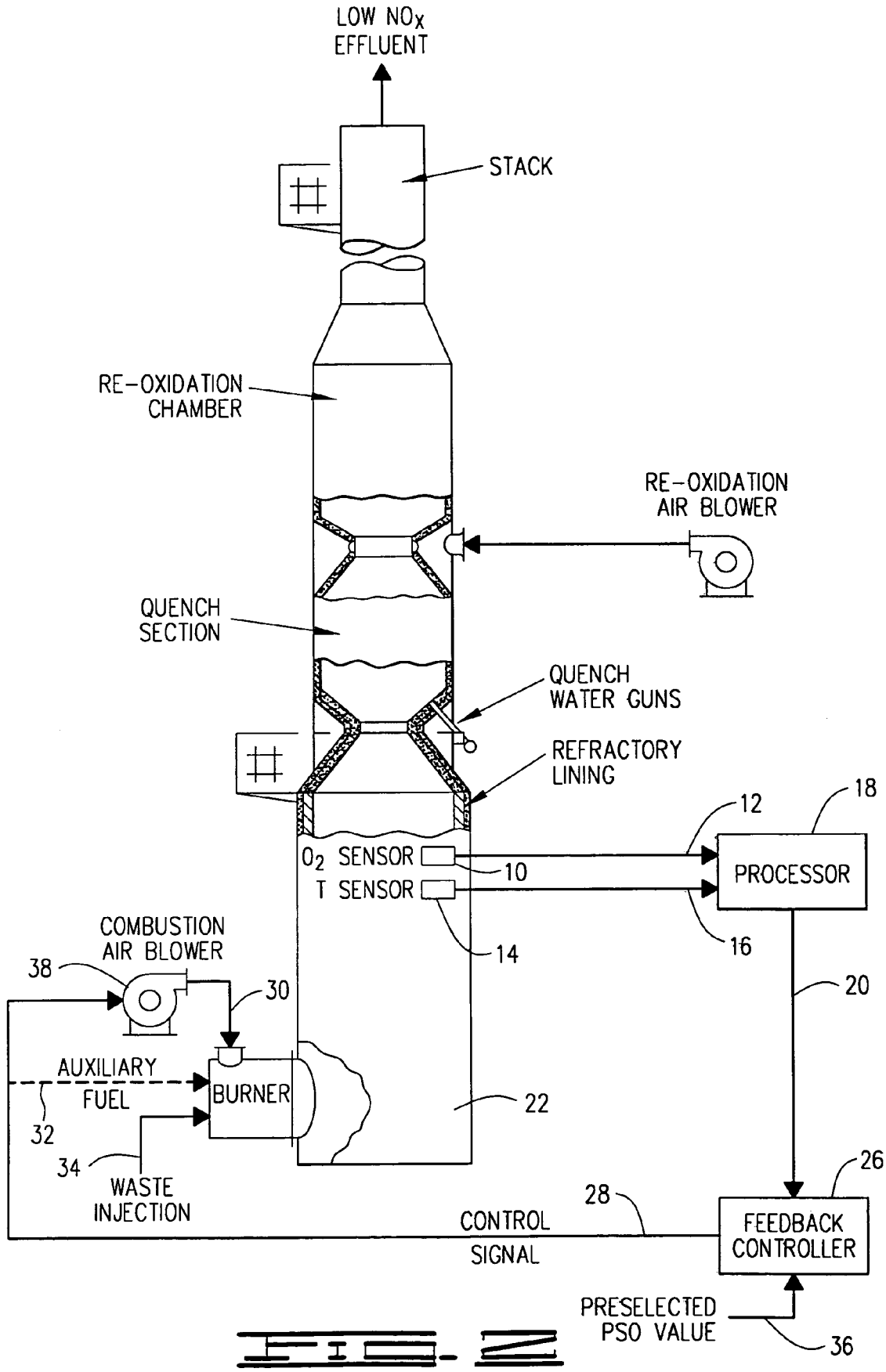
FIG. 2 shows a typical incinerator with the inventive system for controlling the flow rate of combustion air to the pyrolyzing section.

Preferred methods of this invention for controlling the PSO in the pyrolyzing section of an incinerator basically comprise the following steps. An electrical signal 12 is generated corresponding to oxygen concentration in the gases within the pyrolyzing section 22. An electrical signal 16 is generated corresponding to the temperature of the gases within the pyrolyzing section. The electrical signals 12 and 16 corresponding to oxygen concentration and temperature are conducted to a processor 18 for converting the electrical signals to an estimate of the PSO 20 using a mathematical relationship between the electrical signals and the PSO. The mathematical relationship includes adjustment of the PSO estimate due to temperature and temperature variations wherein the temperature is above 1100° F. The PSO estimate 20 is relayed to a feedback controller 26 for generating a combustion air, oxidant or fuel flow control signal 28 to adjust the combustion air 30, oxidant or fuel flow 32 and/or 34 based on the PSO estimate 20 and a pre-selected PSO value 36. The control signal is then relayed to the combustion air blower 38 control device. The general method is shown in FIG. 2.

Air 30 is supplied to the pyrolyzing section 22 of the incinerator by means of a blower 38. The air flow rate can be changed by a number of means including using a valve, changing the blower speed or changing the blower blade pitch. The present invention allows the PSO to be controlled at a pre-selected value 36 by adjusting the blower air flow 30 using a suitable device chosen from the group including, but not limited to, a valve, a blower speed controller or a blower blade pitch adjusting device. This is accomplished by electronically transferring the PSO estimate 20 from the processor 18 to a feedback controller 26. The feedback controller 26 generates a combustion air blower control device signal 28 based on the PSO estimate 20 and a pre-selected PSO value 36 using standard control procedures known to those skilled in the art.

A preferred system for use in measuring the PSO in the pyrolyzing section 22 of an incinerator basically comprises a means for generating an electrical signal 12 corresponding to oxygen concentration in the gases within the pyrolyzing section 22, a means for generating an electrical signal 16 corresponding to the temperature of the gases within the pyrolyzing section 22, and a device 18 for converting the electrical signals corresponding to oxygen concentration and temperature to an estimate of the PSO 20 using a mathematical relationship between the electrical signals and the PSO. The mathematical relationship includes adjustment of the PSO estimate due to temperature and temperature variations wherein the temperature is above 1100° F.

A preferred system for use in controlling the PSO in the pyrolyzing section 22 of an incinerator basically comprises a means for generating an electrical signal 12 corresponding to oxygen concentration in the gases within the pyrolyzing section 22, a means for generating an electrical signal 16 corresponding to the temperature of the gases within the pyrolyzing section 22, a combustion air blower, oxidant or fuel control device for controlling the amount of combustion air 30, oxidant or fuel 32 or 34 to the pyrolyzing section 22 of the incinerator, a device 18 to convert the electrical signals corresponding to oxygen concentration and temperature 12 and 16 to an estimate of the PSO 20 using a mathematical relationship between the electrical signals and the PSO, and a means for generating a control signal 28 for the combustion air control device based on the PSO estimate 20 and a pre-selected PSO value 36.

In order to further illustrate the methods of this invention, the following example is given.

EXAMPLE

In this example, the oxygen sensor is a zirconium oxide, or zirconia, electrolytic cell having a solid state electrolyte that conducts oxygen ions at temperatures above 1400° F. The ion conduction is reflected in a voltage between the two electrodes. The magnitude of the voltage depends upon the concentration of the oxygen across the cell walls (ratios of the oxygen partial pressures) and the temperature of the cell. The cell e.m.f. is determined by the Nernst equation:

$$x=-0.0215(T_r)\mathrm{Log}_{10}(P_O/P_1)$$

where x is the cell output voltage in millivolts; $P_O$ is the partial pressure of oxygen in the cell in %, 20.95%; $P_1$ is the partial pressure of oxygen in the measured process in %; and $T_r$ is the absolute temperature of the probe in degrees K.

The partial pressure of the oxygen in the combustion gases was calculated for equilibrium conditions at various temperatures between 1400° F. and 3000° F. and for different sub-stoichiometric conditions for a methane/air mixture. These values were then input into the Nernst equation to produce the cell output voltages. Then the cell output voltages (x) and the operating temperatures of the combustion gases (T) at the different sub-stoichiometric conditions were empirically evaluated for the sigmoid correlation using nonlinear regression, thus producing the necessary constants to calculate the percent stoichiometric oxidant (PSO) for any condition within the boundary limits of the data. The empirical constants were evaluated to be:

$a=-733.109$; $b=873.246$; $c=1610.403$; $d=15.176$; $e=0.2439$.

The PSO predictions from the resulting correlation were then compared to the known PSO values and displayed in Table 1. It can be seen that the predictions from the sigmoid correlation agree well with the known values of PSO.

TABLE 1

Comparison of PSO predictions and known PSO values

| T (° F.) known | PSO known, % | Oxygen % from equilibrium | sensor output x from Nernst eq (mV) | PSO calculated from Sigmoid correlation, % | relative error of PSO |
|---|---|---|---|---|---|
| 1800 | 99.0 | 2.212E−09 | 621.2 | 98.6 | 0.4% |
| 1800 | 95.2 | 5.043E−11 | 723.4 | 94.0 | 1.3% |
| 1800 | 90.9 | 1.144E−11 | 763.5 | 89.9 | 1.1% |
| 1800 | 80.0 | 1.569E−12 | 817.2 | 80.4 | −0.6% |
| 1800 | 76.9 | 1.042E−12 | 828.3 | 77.7 | −1.0% |
| 2000 | 99.0 | 1.362E−07 | 554.9 | 98.9 | 0.1% |
| 2000 | 95.2 | 3.081E−09 | 666.4 | 94.6 | 0.7% |
| 2000 | 90.9 | 6.928E−10 | 710.3 | 90.4 | 0.5% |
| 2000 | 80.0 | 9.299E−11 | 769.4 | 80.2 | −0.3% |
| 2000 | 76.9 | 6.142E−11 | 781.6 | 77.2 | −0.3% |
| 2200 | 99.0 | 4.602E−06 | 488.0 | 99.2 | −0.2% |
| 2200 | 95.2 | 1.032E−07 | 608.8 | 95.2 | 0.0% |
| 2200 | 90.9 | 2.296E−08 | 656.7 | 91.0 | −0.1% |
| 2200 | 80.0 | 3.004E−09 | 721.4 | 80.0 | −0.1% |
| 2200 | 76.9 | 1.970E−09 | 734.8 | 76.6 | 0.4% |
| 2500 | 99.0 | 3.780E−04 | 386.9 | 99.5 | −0.5% |
| 2500 | 95.2 | 8.406E−06 | 521.7 | 96.0 | −0.8% |
| 2500 | 90.9 | 1.841E−06 | 575.5 | 91.9 | −1.1% |
| 2500 | 80.0 | 2.312E−07 | 648.9 | 79.9 | 0.2% |
| 2500 | 76.9 | 1.500E−07 | 664.3 | 75.9 | 1.3% |

Thus, the present invention is well adapted to attain the objects and advantages mentioned as well as those that are inherent therein. While numerous changes may be made by those skilled in the art, such changes are encompassed within the spirit of this invention as defined by the appended claims.

What is claimed is:

1. A system for determining the PSO in the pyrolyzing section of an incinerator comprising:

a means for generating an electrical signal corresponding to oxygen concentration in the gases within the pyrolyzing section;

a means for generating an electrical signal corresponding to the temperature of the gases within the pyrolyzing section; and a device for converting said electrical signals corresponding to oxygen partial pressure and temperature to an estimate of the PSO using a mathematical relationship between the electrical signals and the PSO, wherein the mathematical relationship includes adjustment of the PSO estimate due to temperature and temperature variations wherein the temperature is above 1100° F.

2. The system of claim 1 wherein the electrical signal corresponding to the oxygen concentration is generated by an oxygen sensor selected from the group consisting of zirconia-based oxygen sensors, electrochemical sensors, microfuel sensors and paramagnetic sensors and positioned in the gases within the pyrolyzing section.

3. The system of claim 1 wherein said oxygen sensor is a zirconia-based oxygen sensor.

4. The system of claim 1 wherein the electrical signal corresponding to the temperature is generated by a temperature sensor selected from the group consisting of thermocouples, resistance temperature detectors, pyrometers and remote temperature devices and positioned to sense the temperature of the gases within the pyrolyzing section.

5. The system of claim 1 wherein the temperature sensor is a thermocouple.

6. The system of claim 1 wherein said mathematical relationship is:

$$PSO=a+b/[1+((x+eT)/c)^d]$$

where x is the oxygen sensor output in millivolts, T is the temperature in ° F., and a through e are empirical constants.

7. The system of claim 6 wherein the oxygen sensor is a zirconia-based oxygen sensor and the empirical constants are as follows:

$a=-733.109$; $b=873.246$; $c=1610.403$; $d=15.176$; $e=0.2439$.

8. The system of claim 1 wherein said mathematical relationship is:

$$PSO=[a+b(x+eT)+c(x+eT)^2+d(x+eT)^3]x100$$

where x is the oxygen sensor output in millivolts, T is equal to ($T_f$-2100) and $T_f$ is the temperature in ° F., and a through e are empirical constants.

9. The system of claim 8 wherein the oxygen sensor is a zirconia-based oxygen sensor and the empirical constants are as follows:

$a=3.424$; $b=-1.3433E\text{-}02$; $c=2.4979E\text{-}05$; $d=-1.5670E\text{-}08$; $e=0.2439$.

10. A system for controlling the operation of an incinerator, said system comprising:

a means for generating an electrical signal corresponding to the oxygen concentration in the gases within the pyrolyzing section of the incinerator;

a means for generating an electrical signal corresponding to the temperature of the gases within the pyrolyzing section;

a device to convert the electrical signals corresponding to oxygen concentration and temperature to an estimate of the PSO using a mathematical relationship between the electrical signals and the PSO, wherein the mathematical relationship includes adjustment of the PSO estimate due to temperature and temperature variations wherein the temperature is above 1100° F.;

a means for generating a flow control signal to adjust a process flow rate based on the PSO estimate, a preselected PSO value, and the process flow, wherein said process flow rate is selected from the group consisting of combustion air, oxidant and fuel flow rates; and a device to adjust the process flow rate corresponding to said control signal.

11. The system of claim 10 wherein the electrical signal corresponding to the oxygen concentration is generated by an oxygen sensor selected from the group consisting of zirconia-based oxygen sensors, electrochemical sensors, microfuel sensors and paramagnetic sensors and positioned in the gases within the pyrolyzing section.

12. The system of claim 10 wherein said oxygen sensor is a zirconia-based oxygen sensor.

13. The system of claim 10 wherein the electrical signal corresponding to the temperature is generated by a temperature sensor selected from the group consisting of thermocouples, resistance temperature detectors, pyrometers and remote temperature devices and positioned to sense the temperature of the gases within the pyrolyzing section.

14. The system of claim 10 wherein the temperature sensor is a thermocouple.

15. The system of claim 10 wherein said mathematical relationship is:

$$PSO=a+b/[1+((x+eT)/c)^d]$$

where x is the oxygen sensor output in millivolts, T is the temperature in ° F., and a through e are empirical constants.

16. The system of claim 15 wherein the oxygen sensor is a zirconia-based oxygen sensor and the empirical constants are as follows:

$$a=-733.109;\ b=873.246;\ c=1610.403;\ d=15.176;\ e=0.2439.$$

17. The system of claim 10 wherein said mathematical relationship is:

$$PSO=[a+b(x+eT)+c(x+eT)^2+d(x+eT)^3]x100$$

where x is the oxygen sensor output in millivolts, T is equal to ($T_f$-2100) and $T_f$ is the temperature in ° F., and a through e are empirical constants.

18. The system of claim 17 wherein the oxygen sensor is a zirconia-based oxygen sensor and the empirical constants are as follows:

$$a=3.424;\ b=-1.3433E\text{-}02;\ c=2.4979E\text{-}05;\ d-1.5670E\text{-}08;\ e=0.2439.$$

* * * * *

UNITED STATES PATENT AND TRADEMARK OFFICE

CERTIFICATE OF CORRECTION

PATENT NO. : 7,318,381 B2
APPLICATION NO. : 10/963051
DATED : January 15, 2008
INVENTOR(S) : Kenny M. Arnold et al.

It is certified that error appears in the above-identified patent and that said Letters Patent is hereby corrected as shown below:

Column 4
Line 63, delete the equation and substitute the following equation therefor:

$$PSO=a+b/[1+((x+eT)/c)^{d}]$$

Claim 18
Delete the equation and substitute the following equation therefor:

$a$ = 3.424; $b$ = -1.3433E-02; $c$ = 2.4979E-05; $d$ = -1.5670E-08; $e$ = 0.2439.

Signed and Sealed this

Ninth Day of December, 2008

JON W. DUDAS
*Director of the United States Patent and Trademark Office*